US005433622A

United States Patent [19]

Galambos

[11] Patent Number: 5,433,622

[45] Date of Patent: Jul. 18, 1995

[54] HIGH VOLTAGE CONNECTOR

[76] Inventor: Louis G. Galambos, 504 Bay Cir., Indian Harbor Beach, Fla. 32937

[21] Appl. No.: 271,050

[22] Filed: Jul. 7, 1994

[51] Int. Cl.[6] ..... H01R 13/52

[52] U.S. Cl. ..... 439/282; 439/181

[58] Field of Search ..... 439/281, 282, 350, 587, 439/588, 274, 275, 181

[56] References Cited

U.S. PATENT DOCUMENTS

| | | | |
|---|---|---|---|
| 2,750,573 | 6/1956 | Mika . | |
| 3,109,690 | 11/1963 | Stevens, Jr. | 439/282 OR |
| 3,297,975 | 1/1967 | Pope | 439/282 OR |
| 4,417,736 | 11/1983 | Herrmann, Jr. | 439/281 X |
| 4,498,719 | 2/1985 | Juris et al. | 439/282 X |
| 4,632,482 | 12/1986 | Punako . | |
| 4,698,027 | 10/1987 | Vandame | 439/271 |
| 4,886,471 | 12/1989 | Fleshman, Jr. | 439/282 X |
| 4,895,533 | 1/1990 | Yagi et al. | 439/587 OR |
| 5,254,013 | 10/1993 | Tanaka | 439/282 X |

*Primary Examiner*—David L. Pirlot
*Assistant Examiner*—Daniel Wittels
*Attorney, Agent, or Firm*—Alvin S. Blum

[57] ABSTRACT

A high voltage electrical connector has a mating pair of male and female contacts, each one soldered to an end of conductors that are to be joined to safely carry a high electrical voltage. One of the contacts is mounted in an insulating sleeve with a smooth outer cylindrical surface. The other contact is mounted in a resilient shroud. The shroud has a smooth bore coaxial with the contacts. At least one ring or ridge extends radially inward from the bore. The ring wipes clean the surface of the sleeve as the shroud is stretched over the sleeve during mating of the contacts. When mated, the ring is tightly compressed against the surface of the sleeve, excluding air and foreign matter from the surface. This prevents arcing and escape of current from the contacts to the surroundings. The shroud greatly increases the voltage that the connector can safely carry. Silicone rubber is a preferred material for the shroud.

18 Claims, 1 Drawing Sheet

HIGH VOLTAGE CONNECTOR

BACKGROUND OF THE INVENTION

The present invention relates to electrical connectors, and more particularly to a safety connector between high voltage electrical conductors which reduces the escape of electric current to the surroundings and to individuals.

When a high voltage electrical conductor is to be connected to another conductor such as a cable, the conductor generally terminates at a contact in one half of a connector for convenience. The contact is generally surrounded and supported by an insulator to provide a long, non-conductive path between the conductor and the surroundings which may include a grounded metal housing supporting the contact, a braided metal coaxial shield or nearby persons. At very high voltages, air may become ionized, forming a conductive path to lower potential surfaces. Moisture in the air or on the insulator, or nearby persons may become conductive pathways for current from the high voltage contact causing loss of function of the circuit to which it is connected or injury to persons and apparatus. Resilient insulating shrouds of connectors of the prior art have been provided to cover the insulator. Their structure has been effective in guarding the connection from outside contact and contamination and in providing mechanical security of the connection, however they have not been very effective in preventing arcing of the voltage to the surroundings.

SUMMARY OF THE INVENTION

It is accordingly an object of the invention to provide a high voltage electrical connection which will operate at a higher voltage before arcing over to surroundings than connectors of the prior art. It is another object to provide such a connector that is inexpensive to produce and simple to use. It is yet another object that the connector overcome certain problems related to contamination on the insulator which may cause voltage loss.

The connector of the invention comprises a mating pair of conductive metal contacts a male and a female, each soldered to a conductor. One of the contacts is mounted in an insulating sleeve member having a smooth outer surface with a generally cylindrical or tapered cylindrical shape. The other contact is mounted in a resilient insulating shroud having a forward portion provided with a bore having a smooth inner wall arranged for resiliently expanding while sliding over the sleeve during mating of the two halves of the connector. The wall of the bore has at least one annular ridge extending radially inward arranged to be deformed and tightly compressed against the sleeve when in mated condition. The ridge wipes the sleeve surface clean like a squeegee during mating, and forces air off the sleeve surface at the mating position, while interposing the highly insulating ridge material in any stray conductive path between the contact and the surroundings.

These and other objects, advantages and features of the invention will become more apparent when the detailed description is considered in conjunction with the drawings.

DETAILED DESCRIPTION OF PREFERRED EMBODIMENTS OF THE INVENTION

Figure 2:
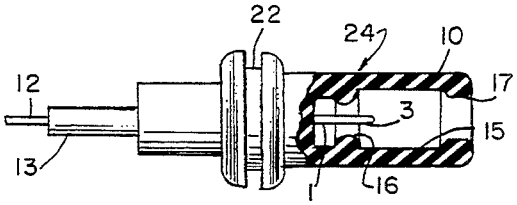
FIG. 2 is a side view, partially broken away, of the male half of the connector of the invention.
Figure 1:
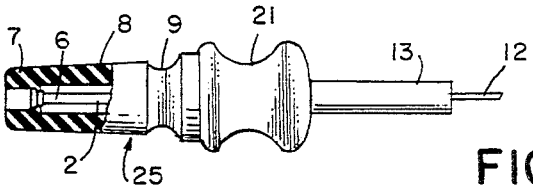
FIG. 1 is a side view, partially broken away, of the female half of the connector of the invention.

Referring now first to FIGS. 1 and 2, insulated wire conductors 13 terminate in a socket portion 25 and a plug portion 24, which mate together. When mated, conductive cylindrical metal male contact 1 has a forward mating portion 3 which fits springably into the forward mating portion 6 of female conductive cylindrical metal contact 2. Each contact is soldered to the conductor 12 of insulated wire 13 so that when mated, electrical continuity is established between the wires. An insulated sleeve 7 surrounds the contact 2. The sleeve has a smooth outer surface 8 having the shape of a tapered cylinder with an annular recess 9. The plug portion 24 is provided with a grommet mounting 22 for mounting in a hole in a panel while the socket portion is provided with a finger grip 21 for forcing the socket onto the plug.

The plug portion 24 is provided with a resilient insulating shroud 10 arranged to slide over and expand on sleeve 7 as the connector is mated. An annular locking ring 17 is molded into the end of the shroud in a position to be received into recess 9 of the sleeve when the connector is fully mated. The locking ring 17 will be stretched as it is forced over the taper of the sleeve and then it will contract to a non-compressed condition when it reaches the reduced diameter recess 21. This action provides secure locking of the mated connector and also provides a detent action to ensure by tactile sensation that the mating action is complete or "popped in". There is another annular ring or ridge 16 on the inner wall 15 of the shroud whose function is quite different from the locking ring 17. Ridge 16 wipes clean the surface of sleeve 7 in a squeegee action as it is forced against larger diameter sleeve 7. When the connector is fully mated, the ridge 16 remains tightly compressed and deformed against the sleeve surface, effectively removing any conductive matter, even potentially ionizable air or gas, from the sleeve at the area of contact. This creates a connection which can sustain a much higher voltage before arcing or failure than the same connector without a ridge 16.

In a typical industrial application of the invention, Applicant found that failure occurred at about 5000 volts in the absence of a shroud. Failure occurred at about 8000 volts with a silicone rubber shroud without an inner ridge 16. Failure occurred at 16,000 volts with a silicone rubber shroud provided with a single inner ridge 16.

Referring now to FIGS. 3, 3*a*, 4, 5 and 6, another embodiment of the invention is shown having two ridges 16 in a shroud 10 attached to the female contact 2. The plug portion 24 of the connector has a metal male contact 1 integral with a metal cap 19. A cylindrical ceramic insulating sleeve 7 is attached to the intermediate portion 4 of the contact, and metal housing 28 at the rear end of the connector is rigidly attached to the sleeve and insulated from the conductor. Alternatively, the sleeve may be made of plastic.

Figure 3:
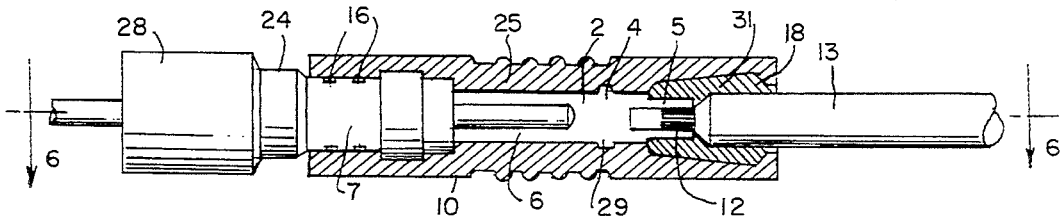
FIG. 3 is a side view of another connector of the invention with the female half in cross section.
Figure 3A:
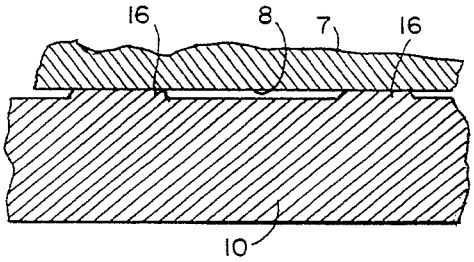
FIG. 3*a* is an enlarged detail sectional view of a portion of FIG. 3 showing compressed ridges.
Figure 6:
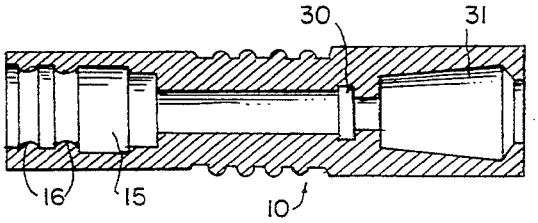
FIG. 6 is a sectional view taken on line 6—6 of FIG. 3 of the shroud portion of the connector of FIG. 3.
Figure 5:
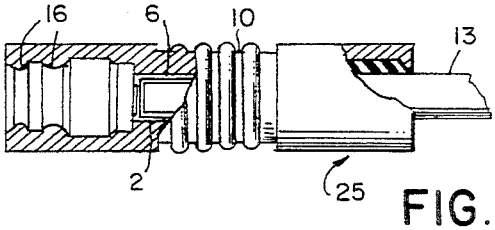
FIG. 5 is a side view, partially broken away, of the female half of the connector of FIG. 3.
Figure 4:
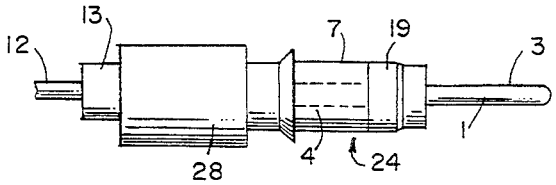
FIG. 4 is a side view of the male half of the connector of FIG. 3.

The socket portion 25 of the connector has a female contact 2 with a forward, mating portion 6, an intermediate portion 4 and a rearward, conductor receiving portion 5 into which the wire 12 of insulated conductor 13 is soldered. The intermediate portion 4 has a radially extending band 29 for holding the silicone rubber shroud 10, securely in place. The shroud may be molded separately as shown in FIG. 6 and then forced into place until the band 29 is seated in the groove 30. Alternatively, the shroud may be insert molded around the contact 2. Silicone rubber having a durometer A of 60/65 has been found to be satisfactory. The shroud 10 is provided with two half-round compression rings or ridges 16, arranged to be tightly compressed and deformed against the ceramic sleeve 7 as best seen in FIG. 3*a*. The compressed ridges force all air off the outer surface 8 of the sleeve 7 at the area of contact with the ridges. This greatly increases resistance to arcing and passage of stray currents to the surroundings which may be conducted by ionized air moisture or foreign matter. A pocket 31 is provided in the shroud at the rearward end of the contact to receive an injection of rubber sealing compound 18 which seals the shroud to the end of the insulated wire 13.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A safety electrical connector for providing electrical continuity between two conductors carrying a high electrical voltage while preventing escape of the voltage to surroundings, said connector comprising:

(A) a mating pair, one male and one female, of cylindrical, electrically conductive contacts, with each contact having a forward mating portion, an intermediate supporting portion and a rearward conductor receiving portion for receiving one of said conductors;

(B) an electrically insulating sleeve member encircling, and affixed to, said intermediate portion of one of said pair, said sleeve member provided with a smooth unindented outer surface portion having a generally cylindrical or tapered cylindrical configuration;

(C) a resilient insulated shroud means encircling and affixed to the intermediate portion of the other of said pair, said shroud means having a forward portion provided with a bore coaxial with said contact, said bore having a smooth inner wall for resiliently expanding when sliding over said smooth outer surface of said sleeve to protectively enshroud said sleeve when said pair are mated, said smooth inner wall being provided with at least one annular radially symmetrical arc suppressing means extending radially inward, said arc suppressing means arranged to be deformed and remain tightly compressed against said smooth unindented outer surface portion of said sleeve member when said contacts are in mated condition to force any conductive matter and air off the surface of the sleeve member at the area of contact to thereby prevent escape of voltage from said contacts to the surroundings.

2. The connector according to claim 1, in which said sleeve member is comprised of a rigid material.

3. The connector according to claim 2, in which said rigid material comprises a ceramic.

4. The connector according to claim 1, in which said one of said pair is a female contact.

5. The connector according to claim 1, in which said one of said pair is a male contact.

6. The connector according to claim 1, in which said one of said conductors is provided with insulation and said shroud means is sealed, at a rearward end to said insulation with an insulated sealing material.

7. The connector according to claim 1, in which said sleeve member is provided on the outer surface thereof with a radially inward directed annular recess and said shroud means is provided on the inner wall thereof with a radially inward directed annular locking ring means for being received in said recess when said connector is in mated condition to provide mechanical security and to provide detent means to ensure complete mating.

8. The connector according to claim 6, in which said one of said conductors is provided with a silicone rubber insulation, said shroud means, and said sealing material are comprised of silicone rubber.

9. The connector according to claim 1, in which said sleeve member is comprised of an insulating plastic material.

10. In a safety electrical connector for providing electrical continuity between two conductors carrying a high electrical voltage while preventing escape of the voltage to surroundings, said connector having a mating pair, one male and one female, of cylindrical, electrically conductive contacts, with each contact having a forward mating portion, an intermediate supporting portion and a rearward conductor receiving portion for receiving one of said conductors, and an electrically insulating sleeve member encircling, and affixed to, said intermediate portion of one of said pair, said sleeve member provided with a smooth unindented outer surface portion having a generally cylindrical or tapered cylindrical configuration, in which the improvement comprises:

a resilient insulated shroud means for encircling and affixing to the intermediate portion of the other of said pair, said shroud means having a forward portion with a bore coaxial with said contact, said bore having a smooth inner wall for resiliently expanding when sliding over said smooth outer surface of said sleeve to protectively enshroud said sleeve when said pair is mated, said smooth inner wall being provided with at least one annular radially symmetrical arc suppressing means extending radially inward, said arc suppressing means arranged to be deformed and remain tightly compressed against said smooth unindented outer surface portion of said sleeve member when said contacts are in mated condition to force any conductive matter and air off the surface of the sleeve member at the area of contact to thereby prevent escape of voltage from said contacts to the surroundings.

11. The shroud means according to claim 10, in which said one of said conductors is provided with insulation and said shroud means is arranged for sealing, at a rearward end, to said insulation with an insulated sealing material.

12. The shroud means according to claim 10, in which said sleeve member is provided on the outer surface thereof with a radially inward directed annular recess and said shroud means is provided on the inner wall thereof with a radially inward directed annular locking ring means for being received in said recess when said connector is in mated condition to provide mechanical security and to provide detent means to ensure complete mating.

13. The connector according to claim 1, in which said arc suppressing means are formed by a thickened wall of said shroud means.

14. The connector according to claim 13, in which said arc suppressing means has a substantially half round configuration.

15. The shroud means according to claim 10, in which said arc suppressing means are formed by a thickened wall of said shroud means.

16. The shroud means according to claim 15, in which said arc suppressing means has a substantially half round configuration.

17. The connector according to claim 13, in which said arc suppressing means approximately doubles the voltage attainable without arcing over the same structure without said are suppressing means.

18. The connector according to claim 15, in which said arc suppressing means approximately doubles the voltage attainable without arcing over the same structure without said arc suppressing means.

* * * * *